US007990219B2

(12) United States Patent
Gleason et al.

(10) Patent No.: US 7,990,219 B2
(45) Date of Patent: Aug. 2, 2011

(54) OUTPUT COMPENSATED VOLTAGE REGULATOR, AN IC INCLUDING THE SAME AND A METHOD OF PROVIDING A REGULATED VOLTAGE

(75) Inventors: Jeffrey A. Gleason, Burnsville, MN (US); David W. Kelly, Eagan, MN (US); Paul Mazur, Cottage Grove, MN (US)

(73) Assignee: Agere Systems Inc., Allentown, PA (US)

( * ) Notice: Subject to any disclaimer, the term of this patent is extended or adjusted under 35 U.S.C. 154(b) by 498 days.

(21) Appl. No.: 12/250,427

(22) Filed: Oct. 13, 2008

(65) Prior Publication Data

US 2010/0090667 A1 Apr. 15, 2010

(51) Int. Cl.
*H92M 3/04* (2006.01)

(52) U.S. Cl. ..... 330/258; 330/253

(58) Field of Classification Search ..... 330/149, 330/145, 250–260, 277; 327/112–113, 359, 327/361, 346; 323/235, 282
See application file for complete search history.

(56) References Cited

U.S. PATENT DOCUMENTS

| | | | | |
|---|---|---|---|---|
| 3,872,390 | A | 3/1975 | Nash | |
| 4,048,573 | A * | 9/1977 | Evans et al. | 330/2 |
| 5,115,205 | A * | 5/1992 | Holmes, Jr. | 330/10 |
| 6,163,218 | A * | 12/2000 | Hashimoto et al. | 330/257 |
| 6,281,752 | B1 * | 8/2001 | Stochino | 330/255 |
| 6,724,257 | B2 * | 4/2004 | Wrathall | 330/253 |
| 7,161,431 | B2 * | 1/2007 | Kronmueller | 330/255 |

* cited by examiner

*Primary Examiner* — Rajnikant B Patel

(57) ABSTRACT

A voltage regulator, a method of regulating voltage and an IC including a voltage regulator. In one embodiment, the voltage regulator includes: (1) a DC precision amplifier configured to generate a DC precision signal based on a reference voltage and a regulated output of the voltage regulator and (2) a response amplifier, coupled in parallel with the DC precision amplifier, configured to generate an error signal based on the reference voltage and the regulated output, the response amplifier further configured to generate the regulated output based on a regulating signal comprised of the error signal and the DC precision signal. The DC precision amplifier may be a CMOS amplifier and the response amplifier may be a NPN amplifier.

24 Claims, 2 Drawing Sheets

OUTPUT COMPENSATED VOLTAGE REGULATOR, AN IC INCLUDING THE SAME AND A METHOD OF PROVIDING A REGULATED VOLTAGE

TECHNICAL FIELD

The invention is directed, in general, to voltage regulators and, more specifically, to a voltage regulator that provides DC precision and a quick response to load changes.

BACKGROUND

Voltage regulators are often used in electrical circuits to provide a constant voltage for logic circuitry. This can prove to be a difficult task due to the influence of the load on the voltage regulators. For example, voltage regulators may be used in a pre-amplifier to provide a regulated voltage for write circuitry of a hard disk drive. As the data of the write circuitry transitions from one state to another, the output of the voltage regulator may dip. The output voltage of the regulator, therefore, can become dependent on the load current. As such, a voltage regulator that does not suffer from pattern dependency would be desirable in the art.

SUMMARY

To address the above-discussed deficiencies of the prior art, one aspect of the invention provides a voltage regulator. In one embodiment, the voltage regulator includes (1) a DC precision amplifier configured to generate a DC precision signal based on a reference voltage and a regulated output of the voltage regulator and (2) a response amplifier, coupled in parallel with the DC precision amplifier, configured to generate an error signal based on the reference voltage and the regulated output, the response amplifier further configured to generate the regulated output based on a regulating signal comprised of the error signal and the DC precision signal.

In yet another embodiment, the voltage regulator includes: (1) a CMOS amplifier configured to receive a reference voltage and employ a source-follower transistor to generate a DC precision signal based on the reference voltage and a regulated output of the voltage regulator, (2) a NPN amplifier configured to receive the DC precision signal, the reference voltage and the regulated output, the NPN amplifier employing a NPN emitter-follower transistor to generate the regulated output based on a regulating signal and (3) a summer configured to generate the regulating signal based on the DC precision signal and an error signal generated by the NPN amplifier.

In still another aspect, the invention provides an IC. In one embodiment, the IC includes (1) logic circuitry and (2) a voltage regulator configured to provide a regulated output for the logic circuitry. The voltage regulator includes: (2A) a DC precision amplifier configured to generate a DC precision signal based on a reference voltage and the regulated output of the voltage regulator and (2B) a response amplifier, coupled in parallel with the DC precision amplifier, configured to generate an error signal based on the reference voltage and the regulated output, the response amplifier further configured to generate the regulated output based on a regulating signal comprised of the error signal and the DC precision signal.

In yet a different aspect, the invention provides a method of providing a regulated voltage. In one embodiment, the method includes: (1) providing a DC precision signal employing a CMOS amplifier, (2) generating an error signal employing a NPN amplifier, (3) summing the DC precision signal and the error signal to provide a regulating signal and (4) using the regulating signal to drive a NPN emitter-follower to generate a regulated voltage.

The foregoing has outlined certain aspects and embodiments of the invention so that those skilled in the pertinent art may better understand the detailed description of the invention that follows. Additional aspects and embodiments will be described hereinafter that form the subject of the claims of the invention. Those skilled in the pertinent art should appreciate that they can readily use the disclosed aspects and embodiments as a basis for designing or modifying other structures for carrying out the same purposes of the invention. Those skilled in the pertinent art should also realize that such equivalent constructions do not depart from the scope of the invention.

BRIEF DESCRIPTION OF THE DRAWINGS

For a more complete understanding of the invention, reference is now made to the following descriptions taken in conjunction with the accompanying drawings, in which.

DETAILED DESCRIPTION OF CERTAIN ASPECTS AND EMBODIMENTS

To reduce pattern dependency on a voltage regulator from load current, a high speed response regulator is disclosed. In addition to a high speed response, the disclosed voltage regulator also provides DC precision needed for the output. Thus, a DC accurate voltage regulator with a quick response to load changes is disclosed herein.

The voltage regulator includes two amplifiers coupled together in parallel to provide DC precision and rapid load response. One of the amplifiers is a DC precision amplifier configured to provide DC precision centered around the DC operating point designated for the voltage regulator. The other amplifier is a response amplifier configured to provide adjustments to the output of the voltage regulator in response to changes in the load. As discussed below, the DC precision amplifier may be a low speed/high gain CMOS amplifier that maintains DC accuracy of the voltage regulator's output voltage. The fast response amplifier may be a high speed/low gain NPN amplifier that drives a bypass capacitor located at the output node of the voltage regulator.

Figure 1:
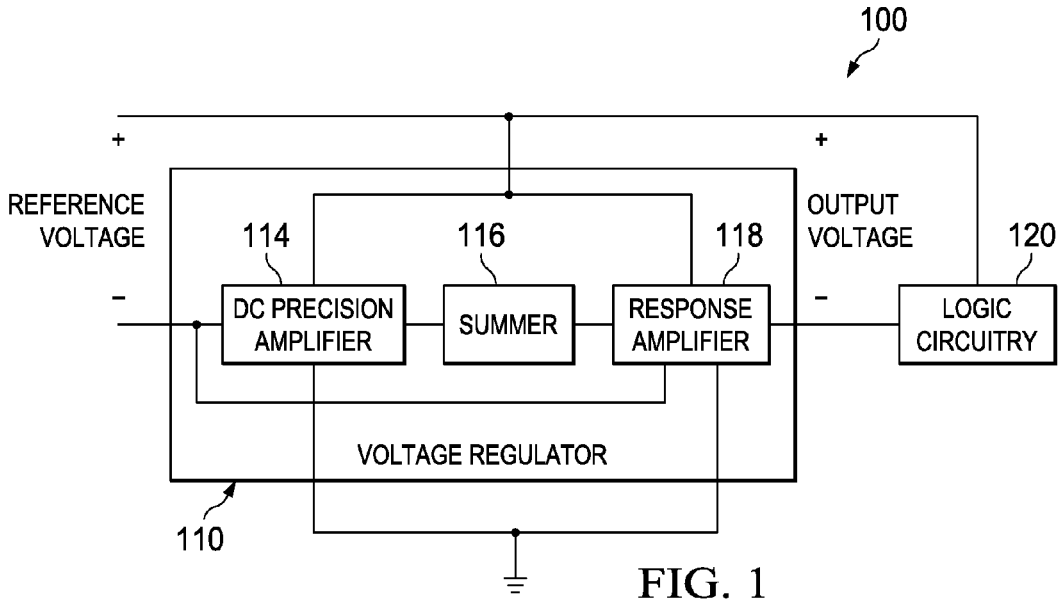
FIG. 1 is a block diagram of an embodiment of an integrated circuit having a voltage regulator constructed according to the principles of the present invention.

FIG. 1 is a block diagram of an embodiment of an integrated circuit (IC) 100 having a voltage regulator 110 constructed according to the principles of the present invention. In addition to the voltage regulator 110, the IC 100 also includes logic circuitry 120. Unlike an off-chip voltage regulator with a large output capacitor, the voltage regulator 110 provides an on-chip alternative with a low impedance connection to the load, the logic circuitry 120. The voltage regulator 110 allows high DC precision, quick response, voltage regulation that is proximate the circuit, the logic circuitry 120, requiring the regulated voltage.

The IC 100 receives an external voltage (i.e., supplied to the IC 100) that is used by the voltage regulator 110 and the logic circuitry 120. From the external voltage, a reference voltage is provided to the voltage regulator 110. The value of the reference voltage may vary according to factors such as the voltage rating of the logic components of the logic circuitry 120. For example, the reference voltage may be 1.2 volts, 1.5 volts or 2 volts with respect to the upper or lower supplied voltage. In addition to the voltage regulator 110 and the logic circuitry 120, the IC 100 may include additional components that are not illustrated but are typically included on a conventional IC.

The logic circuitry 120 is configured to perform logic functions in accordance with designated applications. In one embodiment, the logic circuitry 120 is Complementary metal-oxide-semiconductor (CMOS) logic. The CMOS logic may include complementary MOS transistors configured to perform the designated logic functions. For example, the IC 100 may be a chip of a pre-amplifier for a HDD that is used to write data on a platter of the HDD. As such, the logic circuitry 120 may be the CMOS data path used to write the data. Of course, the logic circuitry 120 may be configured to perform other functions in different embodiments. Additionally, the logic circuitry 120 may be or have other types of logic besides CMOS logic including, for example, n-type MOS (NMOS) logic, p-type MOS (PMOS) logic, Transistor-Transistor Logic (TTL) and Emitter Coupled Logic (ECL)s.

In contrast to traditional, internally compensated voltage regulators, the voltage regulator 110 contains a high speed amplifier loop which is output compensated making the regulator capable of reacting quickly to rapid load changes. The quick response of the voltage regulator 110 may result in less supply bounce on the supply rails of the logic circuitry 120. As such, jitter along the supply rails can be reduced. For example, considering the logic circuitry 120 as the CMOS data path, data path jitter may be reduced.

The voltage regulator 110 is configured to provide a substantially constant output voltage, a regulated voltage, to the logic circuitry 120. The voltage regulator 110 includes a DC precision amplifier 114, a summer 116 and a response amplifier 118. The DC precision amplifier 114 and the response amplifier 118 are coupled in parallel to provide the output voltage. The DC precision amplifier 114 is configured to generate a DC precision signal based on a reference voltage and the regulated output of the voltage regulator 110. The DC precision signal provides DC precision for the regulated output.

The response amplifier 118 is configured to generate an error signal based on the reference voltage and the regulated output. The error signal is generated in response to load changes associated with the voltage regulator 110. The summer 116 is configured to add the DC precision signal and the error signal from the response amplifier 118 to provide a regulating signal. Based on the regulating signal, the response amplifier 118 generates the regulated output.

The summer 116 may be a resistor coupled between the DC precision amplifier 114 and the response amplifier 118. The response amplifier 118 may be a high speed, low gain NPN amplifier and the DC precision amplifier 114 may be a high gain, low bandwidth CMOS amplifier. Embodiments of a high gain, low bandwidth CMOS amplifier and a high speed, low gain NPN amplifier are illustrated and discussed below with respect to FIG. 2.

Figure 2:
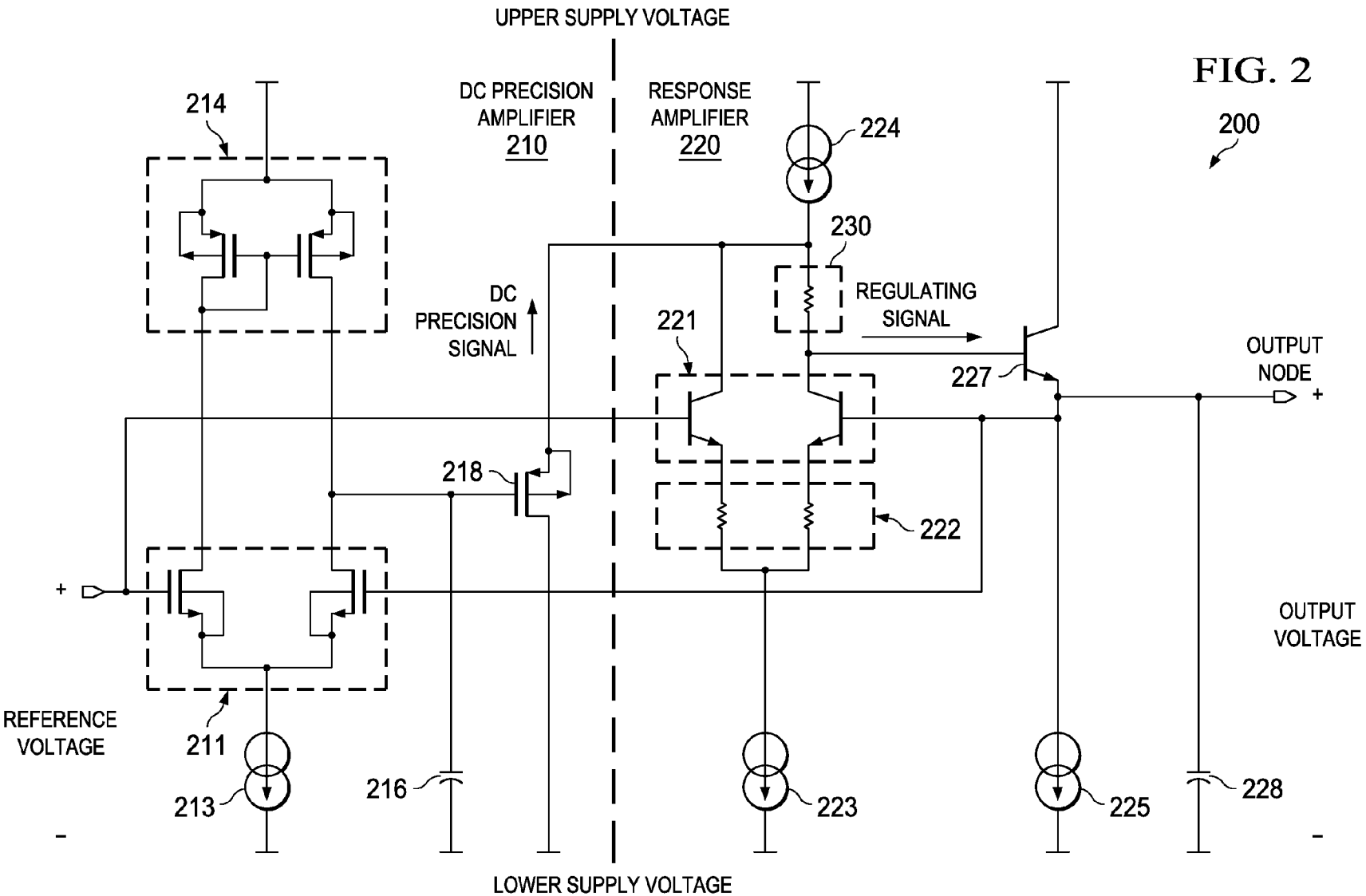
FIG. 2 is schematic diagram of an embodiment of a voltage regulator constructed according to the principles of the present invention.

Turning now to FIG. 2 is schematic diagram of an embodiment of a voltage regulator 200 constructed according to the principles of the present invention. The voltage regulator 200 is an on-chip regulator configured to provide a regulated voltage to a proximate load. The load may be CMOS circuitry that is located on the same chip as the voltage regulator 200.

The voltage regulator 200 includes a DC precision amplifier 210 and a response amplifier 220 coupled together in parallel. An external voltage source provides an upper and a lower supply voltage for the voltage regulator 200 that is used to obtain a reference voltage. The supply voltage and reference voltage may be provided through conventional means typically employed with ICs. The value of the reference voltage may vary according to the desired regulated voltage, output voltage, needed for the load. In some embodiments, the reference voltage may be 1.5 volts or about 1.5 volts with respect to the upper or lower supplied voltage.

The DC precision amplifier 210 is a low speed/high gain CMOS amplifier that maintains DC accuracy of the output of the voltage regulator 200 at the output node. The high gain of the DC precision amplifier 210 facilitates the DC accuracy of the voltage regulator 200. The DC precision amplifier 210 can be considered a Gm stage with a large output capacitor, the output capacitor 216.

In addition to being a high gain amplifier, the DC precision amplifier 210 is a low bandwidth amplifier. The bandwidth of the DC precision amplifier 210 is sufficiently low in order to allow the response amplifier 220 and output capacitance at the output node to dominate the high speed frequency response of the voltage regulator 200. The DC precision amplifier 210 dominates the low frequency behavior of the voltage regulator 200. Thus, the DC precision amplifier 210 may be a slow amplifier having a bandwidth that is lower than the response amplifier 220.

The DC precision amplifier 210 includes a CMOS differential pair 211, a differential pair current source 213, a CMOS current source 214, an output capacitor 216 and a DC driver 218. The CMOS differential pair 211 compares the reference voltage to the output voltage of the voltage regulator 200. The resulting comparison signal is an error signal that is used to drive the DC driver 218 and the output capacitor 216.

The differential pair current source 213 is a conventional current source that provides the bias current for the CMOS differential pair 211. The CMOS current mirror 214 is a conventional component that operates as an active load for the DC precision amplifier 210. The output capacitor 216 is coupled to the gate of the DC driver 218 and is selected to provide a pole that is decades slower (e.g., at least two decades slower) than the dominant pole for the response amplifier loop, set by output driver 227 and bypass capacitor 228.

The DC driver 218 provides the output of the DC precision amplifier 210 to the response amplifier 220 and is used to set the DC output level for the voltage regulator 200. The DC driver 218 receives operating current from a current source (i.e., response amplifier current source 224) of the response amplifier 220, and presents a low impedance input to the summing resistor 230. The DC driver 218 may be a PMOS source-follower as illustrated.

The response amplifier 220 is a high speed, low gain amplifier. The high speed/low gain, response amplifier 220 is a NPN amplifier that drives a bypass capacitor 228 located at the output node of the voltage regulator 200. The response amplifier 220 may have a low gain less than 20 dB to ensure an adequate phase margin. In one embodiment discussed below having a reference voltage of 1.5 volts, the gain of the response amplifier 220 may be 15 dB or about 5. In this embodiment, the DC precision amplifier 210 may have a gain of 60 dB or about 60 dB. The overall gain of the combined amplifiers, the response amplifier 220 and the DC precision amplifier 210, may also be 60 dB (or about 60 dB) at low frequency.

In addition to the bypass capacitor 228, the response amplifier 220 includes an output differential pair 221, differential pair resistors 222, an output differential pair current source 223, a response amplifier current source 224, an output current source 225 and an output transistor 227. The output differential pair 221 is a NPN differential pair that receives the reference voltage and the output voltage and generates an error signal therefrom. The differential pair resistors 222 provide a load on the emitter of the NPN transistors of the output differential pair 221. The output differential pair current source 223, the response amplifier current source 224 and the output current source 225 are conventional devices that provide current for the response amplifier 220.

The output transistor 227 drives the output node of the voltage regulator 200. The output transistor 227 may be a NPN emitter-follower transistor. The output transistor 227 provides a low impedance output for the base current, the regulating signal, and is used to drive the output capacitor 228. The output transistor 227 can then provide the needed current at the output node while the bypass capacitor 228 provides the needed voltage.

The output node needs a sufficient amount of bypass capacitance to provide the dominant pole in the loop stability of the response amplifier 220. As such, the bypass capacitor 228 is selected to provide enough capacitance at the output node to keep the pole at the output node from approaching the secondary pole of the response amplifier 220. The secondary pole of the response amplifier 220 is found at the output of the output differential pair 221 which produces the error signal that is used to drive the output transistor 227. All internal nodes of the response amplifier 220 are designed to have a higher bandwidth than the output node.

A large amount of bypass capacitance at the output node also aids the voltage regulator 200 in maintaining tight output tolerance and is used as compensation for the high speed amplifier loop of the response amplifier 220. Due to the high speed of the response amplifier 220, the response amplifier 220 is quick to react to fast load transients, but because of the low gain, the response amplifier 220 suffers from lack of DC accuracy. The response amplifier 220 is then used to dominate the high frequency behavior of the voltage regulator 200 while the DC precision amplifier 210 is used to provide an accurate DC output level.

The voltage regulator also includes a summer 230 that combines the output of the DC precision amplifier 210, the DC precision signal, with the error signal from the output differential pair 221, to generate a regulating signal that is used to drive the output transistor 227. As illustrated in FIG. 2, the summer 230 may be a resistor coupled to differential pair 221 and the base of the output transistor 227.

One skilled in the art will understand that the ratings and values of the various components of both the DC precision amplifier 210 and the response amplifier 220 are based on the desired output voltage. In one embodiment, where the reference voltage is 1.5 volts to provide a regulated voltage of 1.5 volts, the differential pair current source 213, the output differential pair current source 223, the response amplifier current source 224 and the output current source 225 may be rated at 12 μA, 1.8 mA, 2.1 mA and 1.8 mA, respectively. Additionally, the output capacitor 216 may be a 10 pF capacitor and the bypass capacitor 228 may be a 400 pF capacitor. Furthermore, each of the differential pair resistors 222 may be 15 ohm resistors and the summer 230 may be a 500 ohm resistor.

Figure 3:
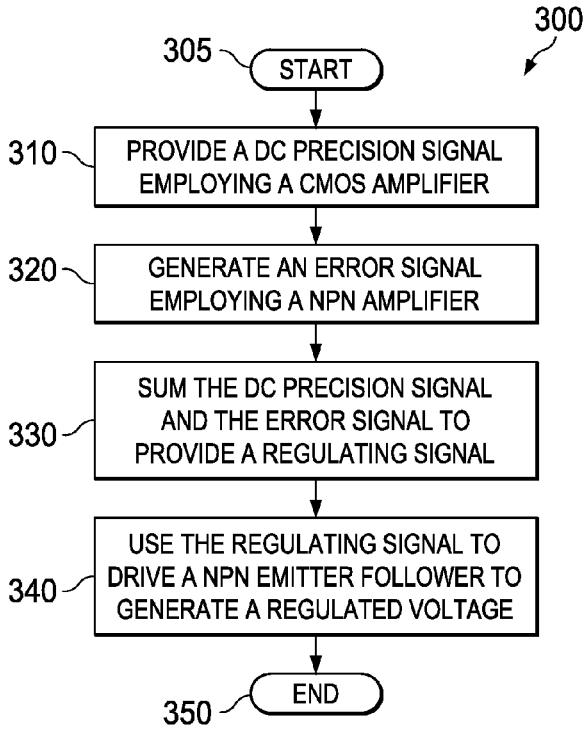
FIG. 3 is a flow diagram of an embodiment of a method of regulating a voltage carried out according to the principles of the present invention.

FIG. 3 is a flow diagram of an embodiment of a method of regulating a voltage carried out according to the principles of the present invention. The method may be realized by employing a voltage regulator as illustrated in FIGS. 1 and 2. The method 300 begins in a step 305 with an intent to provide a regulated voltage.

The method 300 continues by providing a DC precision signal employing a CMOS amplifier in a step 310. In one embodiment, the DC precision signal can be generated by a source-follower transistor of the CMOS amplifier. The source-follower transistor may be driven by a CMOS error signal from a CMOS differential pair of the CMOS amplifier.

Additionally, an error signal is generated employing a NPN amplifier in a step 320. The NPN error signal is generated in one embodiment by a NPN differential pair of the NPN amplifier. The error signal is generated based on a comparison of a reference voltage and an output voltage.

The DC precision signal and the error signal are summed in a step 330 to provide a regulating signal. A summer may be used to combine the NPN error signal and the regulating signal. In one embodiment, the summer may be a resistor coupled between the CMOS amplifier and the NPN amplifier.

In a step 340, the regulating signal is used to drive a NPN emitter-follower to generate a regulated voltage. The base of the NPN emitter-follower, which is an output transistor for the NPN amplifier receives the regulating signal to generate the regulated voltage. The NPN emitter-follower provides a low impedance output that is beneficial in providing proximate voltage regulation for logic loads such as CMOS logic. In a step 350, the method 300 ends.

Those skilled in the art to which the invention relates will appreciate that other and further additions, deletions, substitutions and modifications may be made to the described embodiments without departing from the scope of the invent ion.

What is claimed is:

1. A voltage regulator comprising:

a DC precision amplifier configured to generate a DC precision signal based on a reference voltage and a regulated output of said voltage regulator;

a response amplifier, coupled in parallel with said DC precision amplifier, configured to generate an error signal based on said reference voltage and said regulated output, said response amplifier further configured to generate said regulated output based on a regulating signal comprised of said error signal and said DC precision signal.

2. The voltage regulator as recited in claim 1 wherein said DC precision signal provides DC precision for said voltage regulator.

3. The voltage regulator as recited in claim 1 wherein said error signal is generated in response to load changes associated with said voltage regulator.

4. The voltage regulator as recited in claim 1 wherein said DC precision amplifier includes an output capacitor selected to set the dominant pole for said voltage regulator.

5. The voltage regulator as recited in claim 1 wherein said DC precision amplifier includes an output capacitor selected to provide a pole response that is at least two decades slower than the dominant pole of said response amplifier.

6. The voltage regulator as recited in claim 1 wherein said DC precision amplifier is a high gain, low bandwidth amplifier.

7. The voltage regulator as recited in claim 1 wherein said response amplifier is a high speed, low gain amplifier.

8. The voltage regulator as recited in claim 1 further comprising a summer configured to provide said regulating signal based on said DC precision signal and said error signal.

9. A voltage regulator comprising:

a first amplifier configured to receive a reference voltage and employ a first transistor to generate a DC precision signal based on said reference voltage and a regulated output of said voltage regulator;

a second amplifier configured to receive said DC precision signal, said reference voltage and said regulated output, said second amplifier employing a second transistor to generate said regulated output based on a regulating signal;

a summer configured to generate said regulating signal based on said DC precision signal and an error signal generated by said second amplifier.

10. The voltage regulator as recited in claim 9 wherein said first amplifier is a CMOS amplifier, said first transistor is a source-follower, said second amplifier is a NPN amplifier and said second transistor is a NPN emitter-follower.

11. The voltage regulator as recited in claim 9 wherein said summer couples said first amplifier to said second amplifier.

12. The voltage regulator as recited in claim 9 wherein said second amplifier includes a bypass capacitor coupled to an output node of said voltage regulator, said bypass capacitor selected to provide a secondary pole for said voltage regulator.

13. The voltage regulator as recited in claim 12 wherein said first amplifier includes an output capacitor coupled to said first transistor, said output capacitor selected to provide a pole response that is at least two decades slower than said secondary pole.

14. The voltage regulator as recited in claim 9 wherein said second amplifier has a gain of about five.

15. An integrated circuit, comprising:

logic circuitry; and a voltage regulator configured to provide a regulated output for said logic circuitry and including:

a DC precision amplifier configured to generate a DC precision signal based on a reference voltage and said regulated output of said voltage regulator; and a response amplifier, coupled in parallel with said DC precision amplifier, configured to generate an error signal based on said reference voltage and said regulated output, said response amplifier further configured to generate said regulated output based on a regulating signal comprised of said error signal and said DC precision signal.

16. The integrated circuit as recited in claim 15 wherein said DC precision signal provides DC precision for said regulated output.

17. The integrated circuit as recited in claim 15 wherein said logic circuitry is CMOS logic circuitry.

18. The integrated circuit as recited in claim 17 wherein said integrated circuit is at least part of a preamplifier for a data writer.

19. The integrated circuit as recited in claim 15 wherein said DC precision amplifier is a high gain, low bandwidth CMOS amplifier.

20. The integrated circuit as recited in claim 19 wherein said response amplifier is a high speed, low gain NPN amplifier.

21. The integrated circuit as recited in claim 15 further comprising a summer configured to provide said regulating signal based on said DC precision signal and said error signal.

22. A method of providing a regulated voltage, comprising:

providing a DC precision signal employing a first amplifier;

generating an error signal employing a second amplifier coupled in parallel with said first amplifier;

summing said DC precision signal and said error signal to provide a regulating signal; and using said regulating signal to drive a transistor to generate a regulated voltage.

23. The method as recited in claim 22 wherein said first amplifier is a CMOS amplifier and said second amplifier is a NPN amplifier.

24. The method as recited in claim 23 wherein said transistor is a NPN emitter-follower transistor.

* * * * *